United States Patent [19]

Crippen

[11] Patent Number: 4,497,487

[45] Date of Patent: Feb. 5, 1985

[54] CHANCE DEVICE

[76] Inventor: Henry O. Crippen, 1700 Grand Concourse, Bronx, N.Y. 10457

[21] Appl. No.: 182,234

[22] Filed: Aug. 28, 1980

Related U.S. Application Data

[63] Continuation-in-part of Ser. No. 137,725, Apr. 7, 1980, abandoned.

[51] Int. Cl.[3] ..... A63F 9/04

[52] U.S. Cl. ..... 273/146

[58] Field of Search ..... 273/146; D21/41

[56] References Cited

U.S. PATENT DOCUMENTS

| | | | |
|---|---|---|---|
| 604,401 | 5/1898 | Lang | 273/146 X |
| 1,555,447 | 9/1925 | Bernstein | 273/146 |
| 1,586,429 | 5/1926 | Kiesling | 273/146 |
| 1,765,625 | 6/1930 | Snover | 273/146 UX |
| 3,905,603 | 9/1975 | Hoetzel | 273/146 X |
| 4,055,348 | 10/1977 | Marzoni | 273/146 |
| 4,158,921 | 6/1979 | Stolpen | 273/146 X |
| 4,368,887 | 1/1983 | Gamble | 273/144 B |

FOREIGN PATENT DOCUMENTS

| | | | |
|---|---|---|---|
| 1059816 | 6/1959 | Fed. Rep. of Germany | 273/146 |
| 2383685 | 10/1978 | France | 273/146 |
| 2,421,650 | 11/1979 | France | 273/146 |
| 588254 | 5/1977 | Switzerland | 273/146 |

*Primary Examiner*—Harland S. Skogquist

*Attorney, Agent, or Firm*—Charles A. Muserlian

[57] ABSTRACT

This invention relates to a chance device to be used to anticipate numbers to be selected in a lottery game such as Lotto. The chance device comprises two icosahedrons, one icosahedron having numbers thereon representing ten (10) odd numbers and ten (10) even numbers of from 1 to 40, and the other icosahedron having numbers thereon representing the remaining twenty (20) numbers of from 1 to 40. The sum of the numbers appearing on each icosahedron is four hundred ten (410).

2 Claims, 8 Drawing Figures

CHANCE DEVICE

PRIOR APPLICATION

This application is a continuation-in-part application of my copending application Ser. No. 137,725 filed Apr. 7, 1980, and now abandoned.

FIELD OF THE INVENTION

This invention relates to a chance device. More specifically, the invention relates to a chance device comprised of two icosahedrons.

BACKGROUND OF THE INVENTION

It is known to employ polyhedrally shaped blocks for different purposes. For example, U.S. Pat. No. 1,555,447 discloses a gaming apparatus comprised of an icosahedron having characters thereon in differing frequencies. The subject of U.S. Pat. No. 1,586,429 is a crossword puzzle game consisting of pads having faces formed thereon in block formation and a pair of cooperatively associated dice having all of the letters of the English language alphabet formed thereon. The preferred configuration of each die is an icosahedron. Somewhat similarly, U.S. Pat. No. 4,055,348 is directed to a word building game that uses five chance elements, each of which is a twenty-sided device wherein each side has a character of the English language alphabet.

In U.S. Pat. No. 3,899,838, a teaching aid is described which comprises one or more polyhedrally shaped blocks, each block having a plurality of oppositely spaced parallel sides. In one mode, arithmetic problems are displayed on a given side and the solution thereto is displaced on the oppositively positioned parallel side.

U.S. Pat. No. 3,905,603 discloses a device comprising four substantially idential, symmetrical geometric containers arranged in the shape of a tetrahedron. Each container contains at least one movable element, the movable element preferably being an icosahedron having two sets of the digits 1 to 10.

In recent times, the playing of lottery games has been common, particularly in states such as New York. New York State sponsors a lottery game known as "Lotto", whereby participants can possibly win a first prize of as much as two million dollars or alternative cash prizes. The basic premise of Lotto is that six numbers of from 1 to 40 are selected by random, sequential drawing of air-mixed, numbered balls. The object of the game is to match as many of the numbers as possible. While each of the above-described devices is useful for a particular application, none is helpful in enabling a person to anticipate what numbers might be selected for Lotto.

OBJECTS OF THE INVENTION

It is an object of this invention to provide a novel gaming device.

It is also an object of the invention to provide a gaming device having forty numbered faces.

It is additionally an object of the invention to provide a method of enhancing the prospects of anticipating numbers to be drawn in lottery games.

It is a further object of this invention to provide a method for selecting numbers anticipated to be drawn in a lottery game whereby a player's individual deliberation is avoided and dependence upon the player himself or herself is reduced.

These and other objects of the invention will become more apparent in the discussion below.

DESCRIPTION OF THE INVENTION

The game device of the invention is comprised of a chance device of two icosahedral chance elements having one number on each of the surfaces thereof, one chance element having numbers thereon representing ten odd numbers and 10 even numbers of from 1 to 40 and the second chance element having numbers thereon representing the remaining 20 numbers from 1 to 40, the sum of the numbers appearing on each chance element being 410.

In a modification of the game device of the invention, one of the two chance elements may be provided with a second digit from 0 to 9 on each face arranged so that the same digit will appear on the top face and the opposite bottom face which numbers can be simultaneously read on each of 3 throws in order to pick a number for the popular numbers game.

Applicant has surprisingly discovered a way to enhance the prospects of anticipating the numbers to be drawn in a lottery such as Lotto. The numbers are arranged in a pattern or patterns to enable various sequences of numbers to be selected by throwing or rolling the two dice simultaneously on a suitable flat surface. When the two dice stop rolling, they will each come to rest in a position whereby each die is solely supported by one side or surface and on an oppositely positioned surface one number is uppermost, i.e., on the top side of each die. The two indicated numbers are recorded, and then the dice are rolled again. The sequence is repeated until six different numbers have been recorded. In the event that the number appearing on the uppermost side of a die is the same as a number recorded previously, neither number "showing" is recorded and both dice are immediately re-rolled.

The invention can be appreciated more fully by making reference to the figures.

BRIEF DESCRIPTION OF THE DRAWINGS

FIGS. 1 and 2 represent diagramatic illustrations of the dice of the invention herein in a flattened, planar state. With regard to FIG. 1, the illustration shows the manner in which the triangular sections can be arranged. In the lefthand, five-group hub section 1, the numbers 26,25,06,38 and 05 are positioned clockwise. Similarly, the right-hand, five-group hub section 2 comprises in clockwise fashion the numbers 07,32,31,10, and 21. In addition, FIG. 1 shows the overall arrangement of twenty (20) different numbers on the die, which numbers are all from one to forty and which comprise ten (10) odd numbers and ten (10) even numbers, the total count of which is four hundred ten (410).

FIG. 2 shows the arrangement of twenty (20) numbers on the companion to the die shown in FIG. 1. The numbers indicated represent ten (10) odd numbers and ten (10) even numbers from one to forty that differ from those shown in FIG. 1. Similarly, the total count of the numbers is four hundred ten (410). In the left-hand, five-group hub section 3, the numbers 16,09,39,27, and 12 are arranged in clockwise fashion, and in the right-hand, five-group hub section 4, the numbers 08,36,24,20, and 14 are arranged in clockwise fashion.

FIGS. 3 and 4 represent different, planar views of the arrangements shown in FIGS. 1 and 2, respectively. The numbers set forth in hub sections 1,2,3 and 4 are arranged in the same clockwise fashion as in FIGS. 1 and 2.

FIGS. 5 to 8 represent oblique view of the dice of the invention. FIGS. 5 and 6 represent top and bottom views, respectively, of the die arrangements represented by the planar illustrations in FIGS. 1 and 3. Likewise, FIGS. 7 and 8 represent top and bottom views, respectively of the die arrangements represented by the planar illustrations in FIGS. 2 and 4. More particularly, FIG. 5 shows ten (10) of the twenty (20) triangular faces of one die. The die is in a resting position with the number to be selected, in this case, number 26, directly on the top-most triangular face 5. Directly below the number 26 of a five-group hub 6 having the numbers 26,25,06,38, and 05 arranged in clockwise fashion, can be seen.

FIG. 6 represents an opposite bottom view of the die in resting position depicted in FIG. 5. The number 07 is on the bottom-most triangular face 7, that is, the die is resting on face 7. Directly above the triangle side 7 is a five-group hub section 8 having the numbers 21,10,02,29, and 22 in clockwise fashion.

FIG. 7 shows ten (10) of the twenty (20) triangular faces of the companion die to the die shown in FIGS. 5 and 6. The die is in a resting position with the number to be selected, in this case, number 16, directly on the top-most group hub 10 having the numbers 11,37,03,39 and 09 arranged in clockwise fashion.

FIG. 8 represents an opposite bottom view of the die in resting position depicted in FIG. 7. The number 08 is on the bottom-most triangular face 11. Directly above triangular face 11 is a five-group hub section 12 having the numbers 15,20,23,30, and 13 in clockwise fashion.

FIGS. 4, 7 and 8 illustrate the chance element which may also be used to simultaneously select the three numbers for the numbers game which has the additional number from 0 to 9 in the corner of the triangular faces of the icosahedral chance element. Preferably, these additional numbers are smaller than the main number and are of a different color so that they may be easily distinguished. As noted above, these additional 10 digits: 0,1,2,3,4,5,6,7,8 and 9 are arranged on the 20 faces in a manner that when any one of the 10 figures appears on the top side of the "Roller" ball, that same figure will be directly on the bottom side of that element e.g., when 5 is on the top side, a 5 is directly on the bottom side. This arrangement applies to each of the 10 figures on that one chance element and by recording this single figure along with the "Lotto" numbers, when the elements are rolled 3 times, one will have selected also a 3-digit number as they select 3-digit numbers in the numbers game as well as various lotteries.

Figure 1:
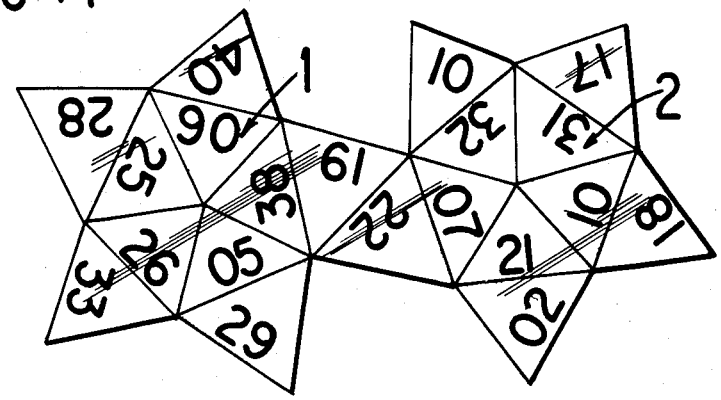
FIGS. 1 and 2 together represent a planar, diagramatic embodiment of the invention.
Figure 2:
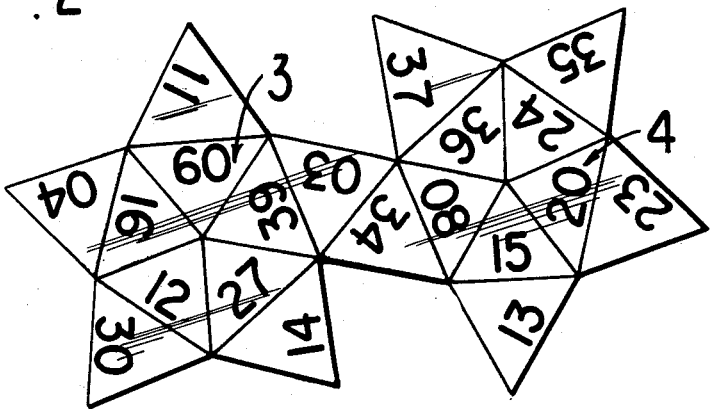
Figure 3:
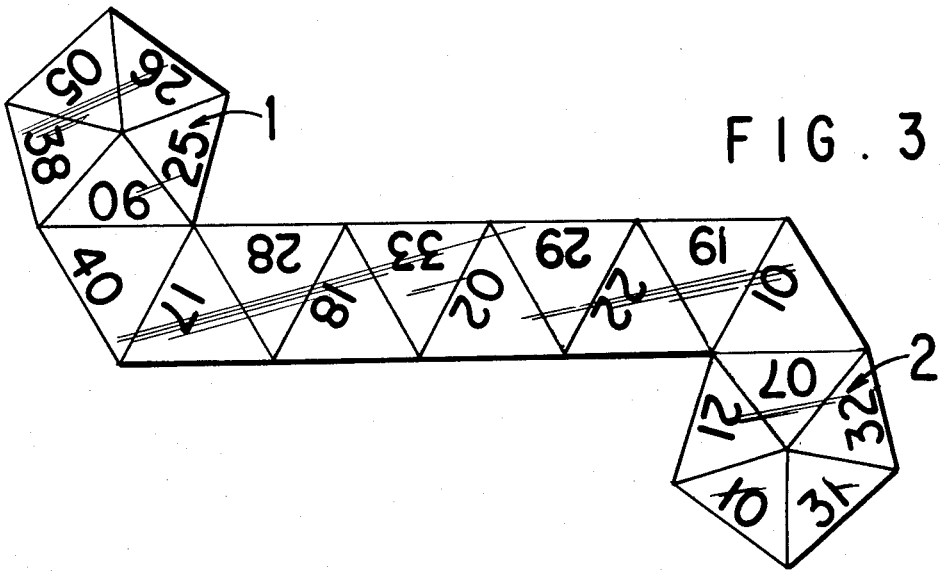
FIGS. 3 and 4 together represent a different planar, diagrammatic embodiment of the invention.
Figure 4:
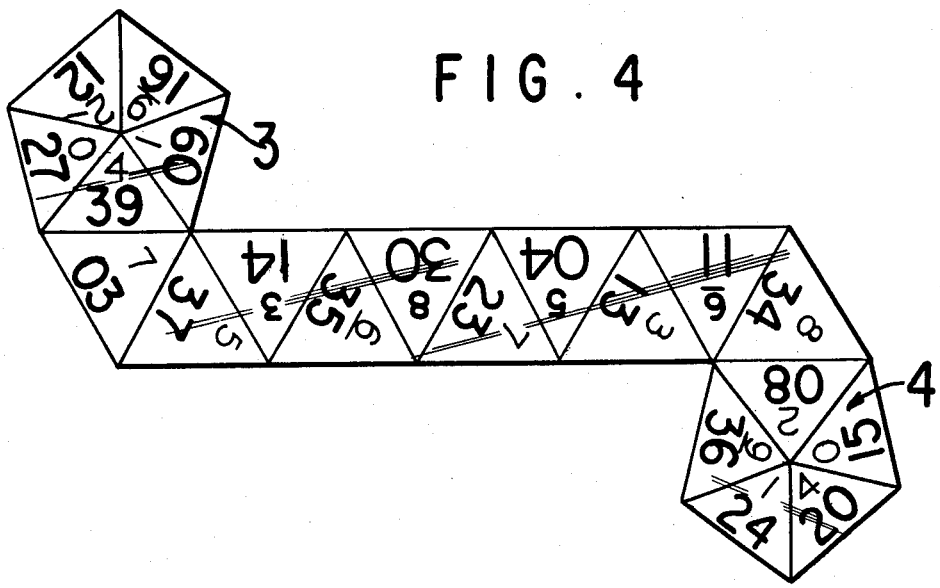
Figure 5:
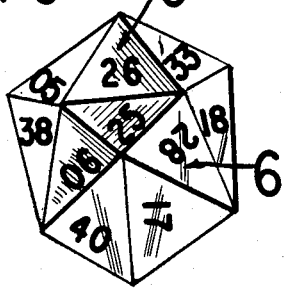
FIGS. 5 and 6 each represent a three-dimensional view of one aspect of the invention as seen obliquely from above.
Figure 6:
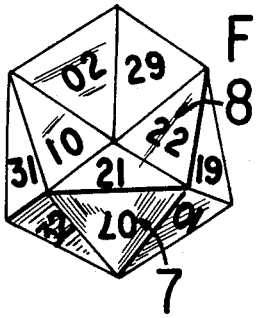
Figure 7:
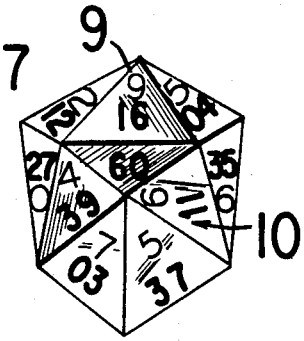
FIGS. 7 and 8 each represent a three-dimensional view of one aspect of the invention as seen obliquely from below.
Figure 8:
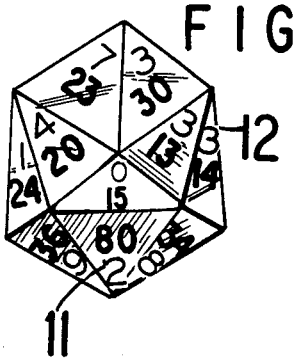

The gaming device of this invention is comprised of two icosahedrons which can be any suitable size and can be manufactured from any suitable material. Preferably, the dice will be the same size and will each have a diameter of from about 1 to 6 inches. This would mean that each edge of the dice would have a dimension of from about 3/8 to 2 inches. It is within the scope of the invention that in actual use the dice could either be much smaller or much larger. A practical limitation concerning the smaller size would be that the numbers would at least be large enough to be readily seen and that the sides of the triangular faces would be large enough to support the dice on whatever surface they are rolled. For example, if the dice were to be rolled on a typical indoor carpet, a large size would be necessary.

The dice can be manufactured from any material upon which numbers can be imprinted. It is anticipated that the dice could be manufactured from any of the numerous polymeric materials in wide spread use, examples of which include the various polystyrenes, polyethylenes, polypropylenes, and polymers and copolymers thereof. Wood, metal, and stiff paper materials could also be employed.

The numbers can be imprinted on the triangular faces by means such as embossing, engraving, applying adhesive numbers or labels, and the like. Preferably the numbers have a height of from about one-quarter to one-half of the length of the side of the triangular face to which they are to be applied. Also, each number is preferably positioned so that the horizontal axis of the number is parallel to one side of the triangular face.

Further, while the description herein is directed to a gaming device comprised of two icosahedral dice, which are to be used to determine six (6) numbers for Lotto, it is within the scope of the invention to provide gaming devices for other lottery games. For example, if a given lottery game comprised picking additional numbers of from 1 to 40, the dice could merely be rolled more often. On the other hand, if the range of numbers were greater, the shape and numbers of the dice may have to be modified or another die may be necessary. The object of the modification would be, as described above, to provide a method of randomly selecting numbers to be drawn in the lottery.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A game device comprising a chance device having two icosahedral chance elements having a number on each of the surfaces thereof, one chance element having numbers thereon representing ten odd numbers and ten even numbers of from 1 to 40, and the other chance element having numbers thereon representing the remaining twenty numbers of from 1 to 40, the sum of the numbers appearing on each chance element being 410 and one of the chance elements has a second number from 0 to 9 on each face with the same number appearing on directly opposite faces of the icosahedral element.

2. A game device of claim 1 wherein the second numbers are smaller and of a different color than the numbers from 1 to 40.

* * * * *